United States Patent [19]

Kasamura et al.

[11] Patent Number: 4,583,832

[45] Date of Patent: Apr. 22, 1986

[54] DEVELOPING DEVICE

[75] Inventors: Toshirou Kasamura; Yasumi Yoshida, both of Yokohama, Japan

[73] Assignee: Canon Kabushiki Kaisha, Tokyo, Japan

[21] Appl. No.: 602,963

[22] Filed: Apr. 23, 1984

[30] Foreign Application Priority Data

Apr. 26, 1983 [JP] Japan ..... 58-73240

[51] Int. Cl.[4] ..... G03G 15/08

[52] U.S. Cl. ..... 355/3 DD; 355/3 R; 355/14 D

[58] Field of Search ..... 355/3 R, 3 DD, 14 D

[56] References Cited

U.S. PATENT DOCUMENTS 4,089,601 5/1978 Navone ..... 355/3 DD X 4,203,386 5/1980 Blöchl et al. ..... 355/3 DD X 4,460,267 7/1984 Ogawa ..... 355/3 DD

*Primary Examiner*—A. C. Prescott

*Attorney, Agent, or Firm*—Fitzpatrick, Cella, Harper & Scinto

[57] ABSTRACT

In a developing device adapted to be removably mounted with respect to an image forming apparatus, there are provided protective cover members for covering and protecting a developing sleeve for developing a latent image on an image bearing member and spacer rollers for maintaining the gap between the image bearing member and the developing sleeve at a predetermined distance. Opening-closing of these protective cover members is effected in response to operation of a member such as a handle which is capable of being drawn out with respect to the developing device.

18 Claims, 8 Drawing Figures

DEVELOPING DEVICE

BACKGROUND OF THE INVENTION

1. Field of the Invention

This invention relates to a developing device in an image forming apparatus wherein a latent image such as an electrostatic latent image, a potential latent image or a magnetic latent image formed on the surface of an image bearing member such as a photosensitive member, a dielectric member or a magnetic member by electrophotography, electrostatic recording or magnetic recording is developed by a powder developer to thereby obtain an image, and in particular to a developing device adapted to be removably mounted with respect to the image forming apparatus.

2. Description of the Prior Art

As the construction of the developing device in an image forming apparatus, there is a housing for containing a developer therein and an opening is provided in the housing. A developer conveying member such as a developing sleeve for supplying the developer in the housing from the opening to the surface of an image bearing member is disposed so as to face the outside.

Now, in the case of maintenance, inspection or repair of the image forming apparatus body or the developing device, the developing device as described above is sometimes removed from the image forming apparatus body to smooth such work. Further, with the recent advance of the multicoloration of developer, it has become possible to obtain images of desired colors by interchanging developing devices exclusively for use with developers of various colors with respect to the image forming apparatus body and therefore, the occasion for removing the developing device from the image forming apparatus body has been increased. For this reason, the developing device has been improved so as to be readily removably mountable with respect to the image forming apparatus body.

However, when the developing device is removed from the image forming apparatus, the removed developing device is in a state in which the developer conveying member facing the outside through the opening of the housing is exposed. Therefore, the developer on the surface of the developer conveying member is liable to be scattered outwardly of the developing device by wind, vibration or an inadvertent touch with the exposed developer conveying member and thus, the floor or like place on which the removed developing device is placed, the operator's hands and clothes or the external surface of the developing device are liable to be stained by the developer. Also, the developer conveying member in its exposed state may inadvertently touch some other object and thereby the surface thereof may be damaged, or when the developer conveying member has some magnetism, magnetic materials such as small screws or metal pieces may be attracted by the magnetic force and if the operator re-mounts the developing device into the image forming apparatus without noticing it and operates the apparatus, the surface of said member may be injured to cause deterioration of formed images or otherwise hamper the normal function of the image forming apparatus body.

Also, in a developing device of the type in which there is provided a member which bears against the image bearing member and development is effected with a predetermined gap maintained thereby between the image bearing member and the developer conveying member, maintaining the gap constant is important to obtain good images. However, if the surface of the member which bears against the image bearing member is damaged, it will become difficult to maintain said gap always at a predetermined distance and accordingly, the gap between the image bearing member and the developer conveying member will fluctuate, and this will adversely affect the formed images.

SUMMARY OF THE INVENTION

It is an object of the present invention to provide a developing device which eliminates the above-noted disadvantages peculiar to the device according to the prior art.

It is another object of the present invention to provide a developing device which can prevent damaging of the developer conveying member and scattering of developer when the developing device is removed from an image forming apparatus.

It is still another object of the present invention to provide a developing device which can prevent damaging of a gap holding member for holding the gap between the image bearing member and the developer conveying member.

Other objects and features of the present invention will become more apparent from the following detailed description taken in conjunction with the accompanying drawings.

DESCRIPTION OF THE PREFERRED EMBODIMENTS

Description will first be made of an image forming apparatus to which the present invention is applicable.

Figure 1:
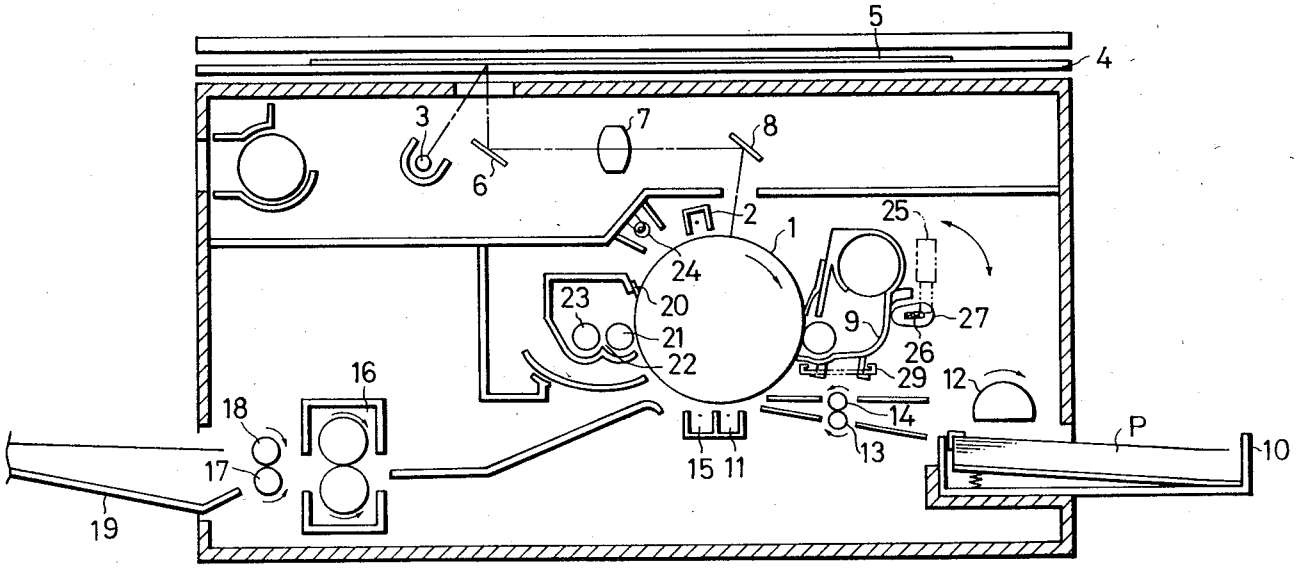
FIG. 1 is a schematic view of an electrophotographic apparatus showing an example of the image forming apparatus to which the present invention is applicable.

FIG. 1 is a schematic view of an electrophotographic apparatus showing an example of the image forming apparatus to which the present invention is applicable. A photosensitive drum 1 as an image bearing member is rotated in the direction of the arrow and is first uniformly charged by a corona discharger 2 as it is rotated. Subsequently, the reflected light image of an original 5 on an original supporting table 4 illuminated by an illuminating light source 3 is formed on the photosensitive drum 1 through a mirror 6, a lens 7 and a mirror 8, whereby a latent image corresponding to the light image of the original is formed on the drum 1. This latent image is developed by a developing device 9 (the details of which will be described later) and a toner image thus obtained is transferred to transfer paper P fed from a paper supply cassette 10, by the action of a transfer corona discharger 11. Reference numeral 12 designates a feed-out roller for feeding transfer paper P from the paper supply cassette 10, and reference numerals 13 and 14 denote timing rollers for feeding the transfer paper P to a transfer station in synchronism with the rotation of the photosensitive drum to transfer the toner image on the photosensitive drum to the transfer paper P. After the image transfer, the transfer paper P is separated from the photosensitive drum 1 by a separating charger 15, and the toner image is fixed on the transfer paper P by a fixing device 16, whereafter the transfer paper P is discharged onto a paper discharge tray 19 by paper discharge rollers 17 and 18.

On the other hand, any toner remaining on the surface of the photosensitive drum 1 is scraped off by a cleaner blade 20 and collected by a magnet roller 21, whereafter it is scraped off by a scraper 22 and discharged into a waste toner collecting container, not shown, by a cleaner screw 23. Also, any residual charge remaining on the photosensitive drum 1 is removed by the illuminating light of an illuminating device 24. Then, the photosensitive drum 1 is again charged by the discharger 2 and the above-described process is repeated.

Figure 2:
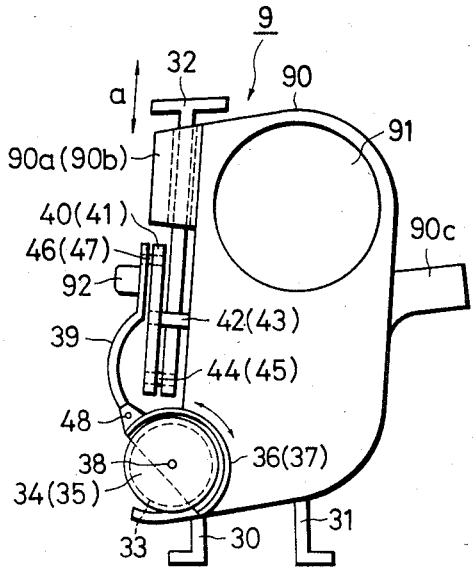
FIG. 2 is a side view of a developing device according to an embodiment of the present invention.

The developing device 9 according to the present embodiment will now be described by reference to FIGS. 2 and 3. In these Figures, reference numeral 90 designates the housing of the developing device for containing developer therein. A developer cartridge, not shown, is inserted through a developer supply opening 91 and the developer is supplied into the housing. Reference numeral 33 denotes a developing sleeve as a developer conveying member for carrying the developer thereon and conveying the developer to the surface of the latent image on the photosensitive drum. The developing sleeve 33 has a magnetic member secured therein. This developing sleeve is disposed with a part thereof exposed through an opening provided at that side of the housing which faces the photosensitive drum. Reference numerals 34 and 35 designate spacer rollers provided at the opposite ends of the developing sleeve 33. The spacer rollers 34 and 35 each have an outside diameter somewhat greater than the outside diameter of the developing sleeve. By these spacer rollers 34 and 35 bearing against the photosensitive drum 1, a gap of a predetermined distance is formed between the photosensitive drum 1 and the developing sleeve 33. The developing sleeve 33 and the spacer rollers 34 and 35 are disposed in the housing 90 for rotation about a support shaft 38.

Reference numeral 32 denotes a handle for carrying the developing device. The handle 32 is mounted in the protrusions 90*a* and 90*b* of the housing 90 for movement only in the directions of bidirectional arrow a (upward and downward directions). Designated by 39 is a protective cover for the developing sleeve 33. The protective cover 39 is connected to the handle 32 by connecting members 40 and 41. These connecting members 40 and 41 at their central portions are mounted for pivotal movement about support shafts 42 and 43 fixed to the housing 90 of the developing device, and one end 40*a*, 41*a* thereof is pivotably mounted on the lower end portion 32*a*, 32*b* of the handle 32 by engaging members 44, 45 and the other ends 40*b*, 41*b* thereof are pivotably mounted on the upper opposite ends 39*a* and 39*b*, respectively, of the protective cover 39 for the developing sleeve by engaging members 46 and 47.

Pins 48 and 49 are fixed to the lower opposite ends 39*c* and 39*d*, respectively, of the protective cover 39, and these pins 48 and 49 are attached to protective covers 36 and 37, respectively, for the spacer rollers 34 and 35. These protective covers 36 and 37 are rotatable about the support shaft 38 in the direction of the arrow.

Legs 30 and 31 extending below and in the lengthwise direction of the housing 90 are for engagement with rail members provided in the image forming apparatus body (hereinafter referred to as the apparatus body), and provide the guide portions of the developing device when the developing device is mounted into or dismounted from the image forming apparatus.

The operation of drawing out the handle 32 will now be described by reference to FIGS. 3 and 4. When the handle 32 is drawn out, the handle 32 is moved upwardly while having its direction determined by the protrusions 90*a* and 90*b* of the housing 90. At this time, the end portions 40*a* and 41*a* of connecting members 40 and 41 pivot about support shafts 42 and 43, respectively, in the directions of arrows b and c, respectively, of FIG. 3. Simultaneously therewith, the end portions 40*b* and 41*b* of the connecting members 40 and 41 pivot downwardly about the support shafts 42 and 43, respectively, thereby depressing the protective cover 39 of the developing sleeve. Thus, the exposed portion of the developing sleeve 33 is covered with the protective cover 39. At this time, pins 48 and 49 engaged with the protective covers 36 and 37 of the spacer rollers 34 and 35 also rotate on the circumference centered at the support shaft 38 and therefore, the protective covers 36 and 37 of the spacer rollers also rotate about the support shaft 38 at a time and cover the side of the spacer rollers 34 and 35 which bear against the photosensitive drum. When the protective covers 36, 37 and 39 cover the spacer rollers 34, 35 and the developing sleeve 33, respectively, the end portions 40*a* and 41*a* of the connecting members 40 and 41 which are adjacent to the handle bear against the protrusions 90*a* and 90*b*, respectively, so that the handle 32 cannot be moved upwardly any further. In this state, the side of the developing sleeve 33 and the spacer rollers 34, 35 which faces the photosensitive drum is covered with the protective covers 39 and 36, 37, and this leads to the possibility of obviating the problem that when the developing device 9 is to be dismounted from the apparatus body and transported, the developer adhering to the developing sleeve 33 scatters or the developing sleeve 33 and the spacer rollers 34, 35 are struck against something other and the surfaces thereof are damaged thereby.

Figure 3:
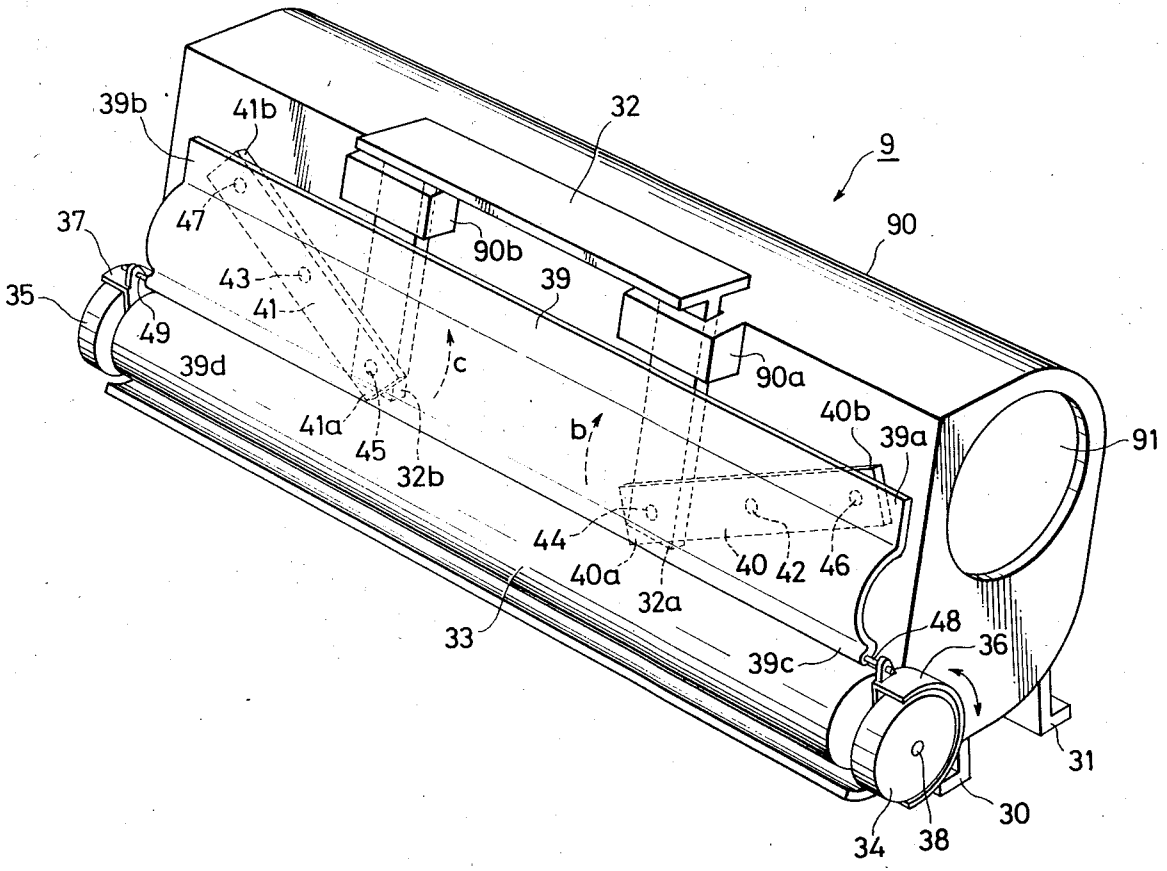
FIG. 3 is a perspective view of the developing device according to an embodiment of the present invention.
Figure 4:
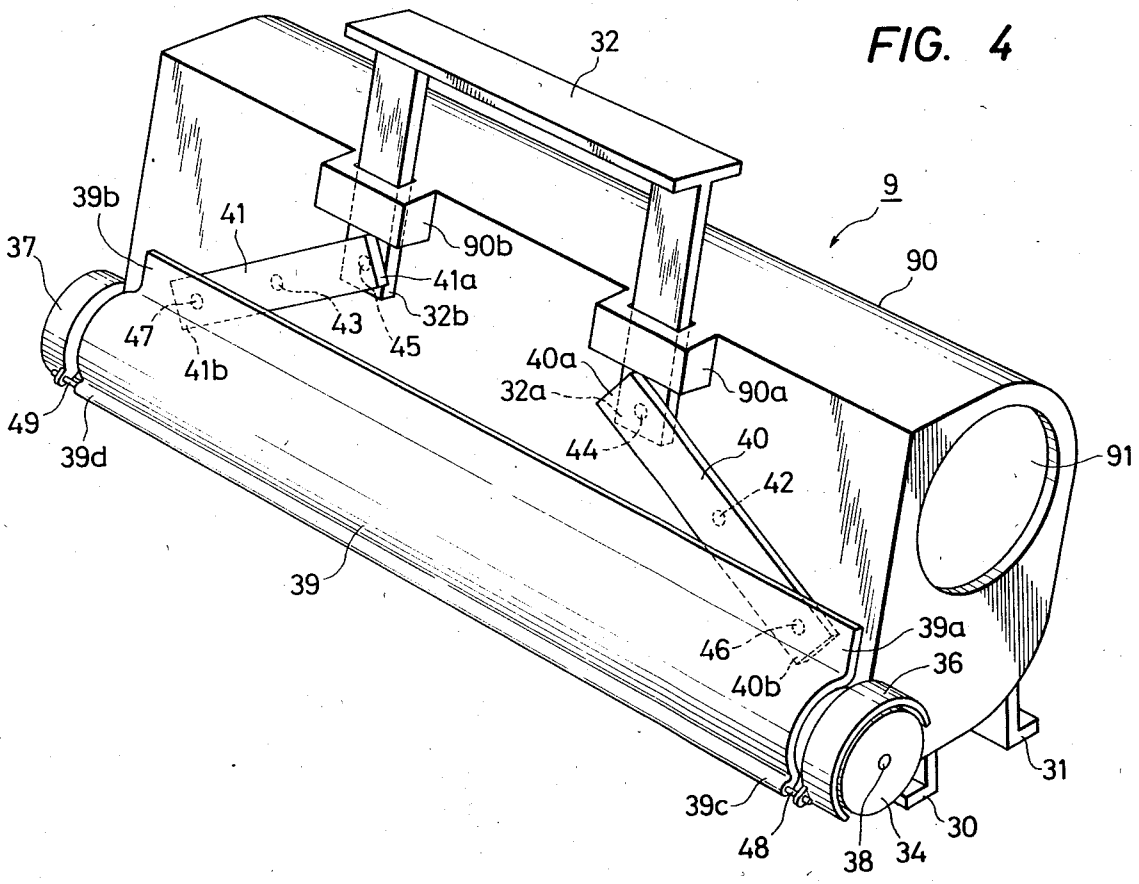
FIG. 4 is a perspective view of the developing device according to an embodiment of the present invention with the handle thereof shown in its drawn-out position.
Figure 5A:
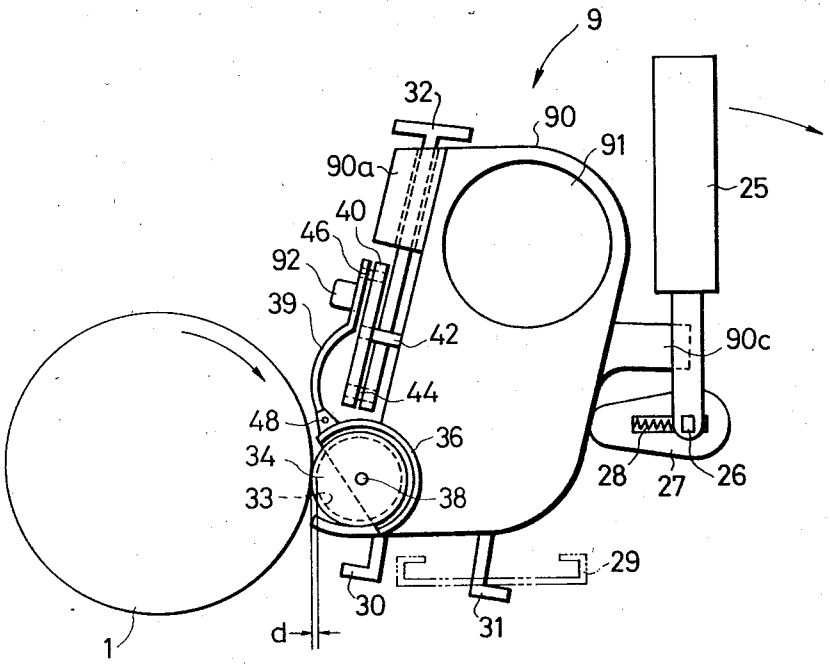
FIGS. 5(*a*)–5(*d*) illustrate the operation involved when the developing device according to an embodiment of the present invention is mounted and dismounted with respect to the image forming apparatus.
Figure 5B:
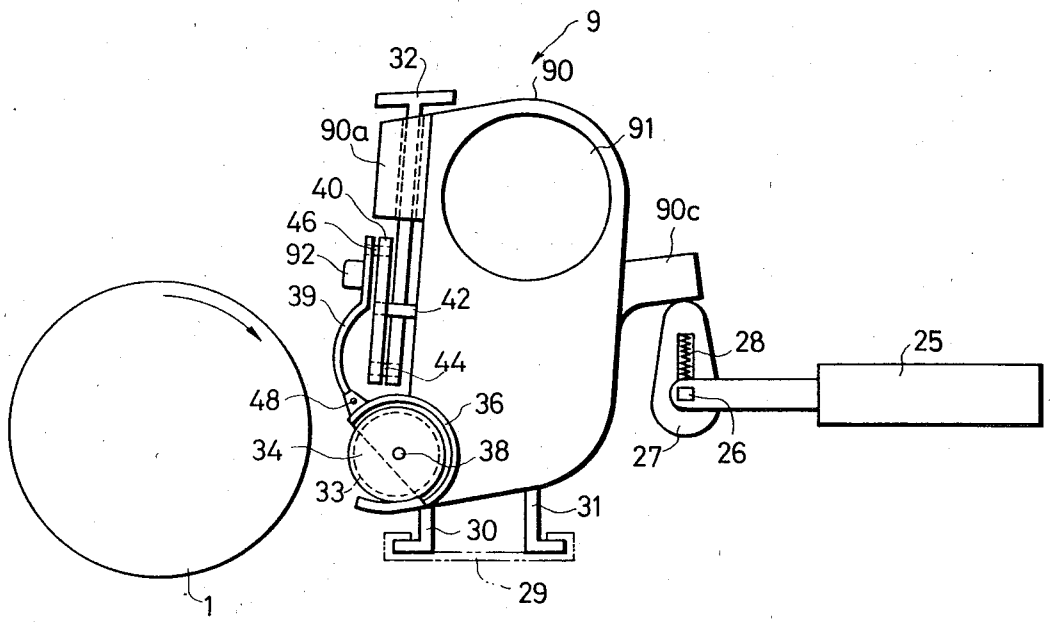
Figure 5C:
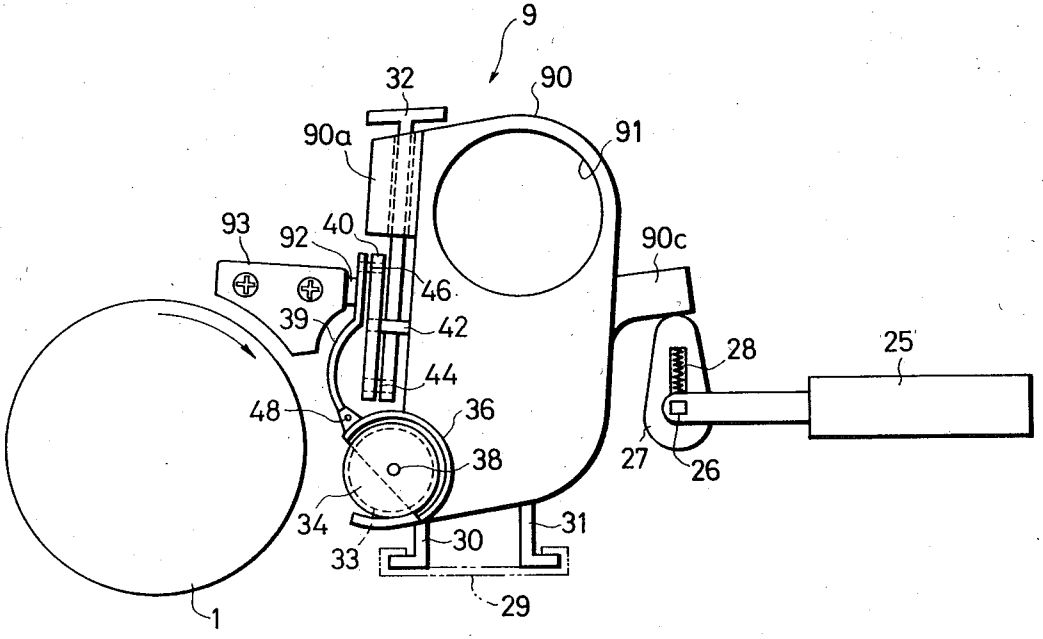
Figure 5D:
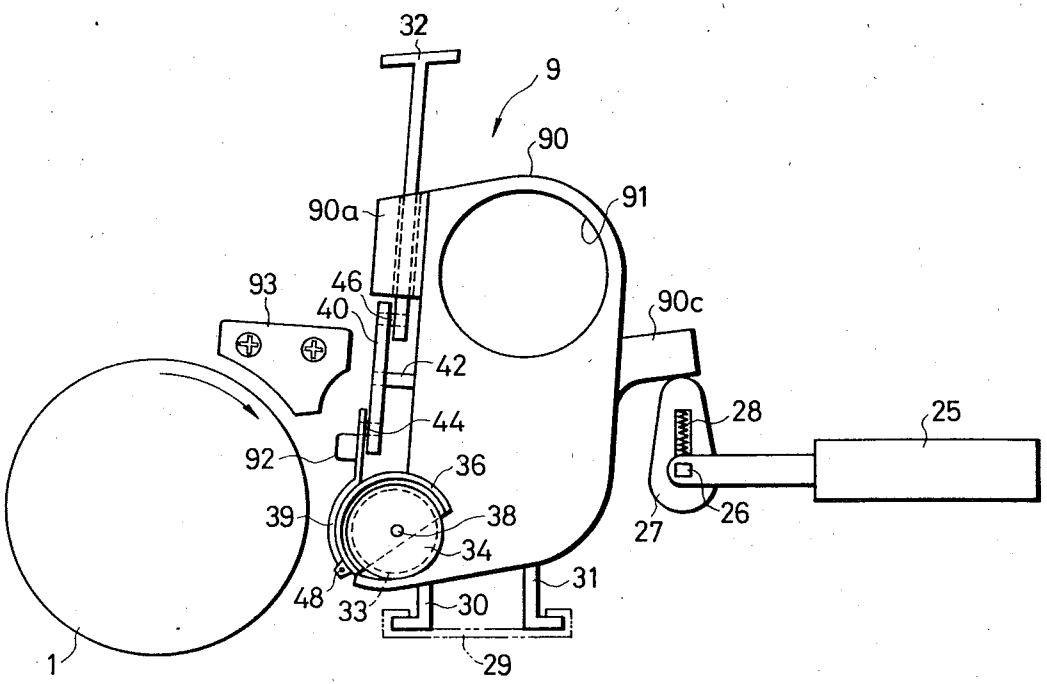

As described above, the developing device in the present embodiment is designed such that the protective cover 39 of the developing sleeve and the protective covers 36, 37 of the spacer rollers operate in response to operation of the handle 32, and by raising the handle 32 upwardly from the position of FIG. 3, the protective covers cover the exposed portions of the developing sleeve and spacer rollers which face the photosensitive drum and, by depressing the handle 32 downwardly from the position of FIG. 4, an operation converse to what has been previously described takes place and the protective covers uncover the exposed portions of the developing sleeve and spacer rollers which face the photosensitive drum.

In the present embodiment, the protective covers of the developing sleeve and spacer rollers have been shown as separate members which are engaged with each other, but of course, they may be made into a unitary structure and connected to the handle.

Further, in the present embodiment, both of the developing sleeve and the spacer rollers have been shown as being protected, but, for example, in a developing device which does not employ the spacer rollers, only the developing sleeve as a developer conveying member may be protected by the protective cover and, even in a developing device which requires the spacer rollers, design may also be made such that either only the developing sleeve or only the spacer rollers are protected by the protective covers.

The operation of mounting or dismounting the above-described developing device with respect to the image forming apparatus will now be described by reference to FIGS. 5(*a*) to 5(*d*).

FIG. 5(*a*) shows a state in which the developing device 9 is mounted in the apparatus body and installed at a predetermined position relative to the photosensitive drum 1. (The photosensitive drum and the developing device are schematically shown). The housing 90 of the developing device has a pressure applied thereto by a spring 28 provided on a stopper 27, and the aforedescribed spacer rollers 34 and 35 bear against the opposite end portions of the photosensitive drum 1. Thus, a gap d is formed between the photosensitive drum 1 and the developing sleeve 33. The developing device becomes ready to effect development in this position.

When the developing device 9 is to be removed from the apparatus body, the body front door (not shown) openable-closable relative to the apparatus body is opened and a release lever 25 is pivoted clockwise about a support shaft 26 rotatably provided on the front side plate (not shown) of the body to thereby release a stopper 27. At this time, the stopper 27 raises the projected portion 90*c* of the developing device housing 90 and the developing device 9 retracts from the photosensitive drum 1. While the developing device 9 is being drawn out to this side relative to the apparatus body as viewed in the Figure, the legs 30 and 31 of the developing device 9 are brought into engagement with a rail member 29 extending from the front side plate of the body to the vicinity of the inside of the body front door and fixed to the body (FIG. 5(*b*)).

Further, when the developing device 9 is sufficiently drawn out of the apparatus body along the rail member 29, the developing device 9 is stopped by a stopper (not shown) disposed at an arbitrary position on the rail member 29 and, as shown in FIG. 5(*c*), a projected portion 92 fixedly provided on the inner side of the protective cover 39 of the developing sleeve with respect to the lengthwise direction thereof comes into engagement with a stopper member 93 fixed to the front side plate (not shown) of the body by a fixing member such as a screw, so that the developing device 9 cannot be drawn out any further. In this position, the developing device 9 can be removed from the apparatus body. However, the stopper member 93 on the apparatus body side and the projected portion 92 on the developing device side and in engagement with each other and therefore, the developing device cannot yet be removed in this state. Therefore, by drawing out the handle 32 as previously described, the developing device is brought into a position as shown in FIG. 4. Thus, as shown in FIG. 5(*d*), the engagement between the projected portion 92 of the protective cover 39 of the developing sleeve and the stopper member 93 fixed to the front side plate of the body is released. In FIGS. 3 and 4, the above-mentioned projected portion 92 is not shown. In the position of FIG. 5(*d*), the developing device is unable to effect development.

As described above, design is made such that the projected portion 92 of said protective cover comes into engagement with the stopper member 93 of the apparatus body after the developing device 9 has been drawn out along the rail member 29 and therefore, even if an attempt is made to draw out the developing device in this position, the developing device cannot be drawn out of the apparatus body, but can be removed only when the handle 32 is drawn out of the developing device and the engagement between the projected portion 92 of the protective cover and the stopper member 93 is released. Accordingly, the operation of drawing out the handle for carrying the developing device must be effected without fail when the developing device is to be removed from the apparatus body and therefore, inadvertent falling of the developing device can be prevented, and this is effective in maintaining safety and operability.

Also, design is made such that in response to the operation of drawing out the handle 32, the protective cover 39 of the developing sleeve and the protective covers 36 and 37 of the spacer rollers cover that side of the developing sleeve 33 and the spacer rollers 34 and 35 which faces the photosensitive drum and therefore, when the developing device is to be removed from the image forming apparatus body and transported, damages of various parts of the image forming apparatus or deterioration of image which may result from the developing sleeve and the spacer rollers being struck against another body or from magnetic materials adhering to the developing sleeve can be obviated.

Also, the protective cover 39 covers the developing sleeve 33 in response to movement of the handle when the developing device is removed from the image forming apparatus and therefore, scattering of the developer adhering to the developing sleeve can be prevented and thus, the operator's hands and clothes will never be stained.

On the other hand, when the developing device 9 is to be mounted into the apparatus body, the legs 30 and 31 of the developing device are placed onto the rail member 29 of the body with the handle 32 remaining drawn out and the developing device is inserted into the apparatus body to some extent. Since the handle 32 remains drawn out, the handle 32 will strike against the frame member on this side of the apparatus body if an attempt is made to further insert the developing device into the apparatus body. If, at this time, the handle 32 is depressed, the protective covers 36, 37 and 39 will be retracted from that side of the spacer rollers 34, 35 and developing sleeve 33 which faces the photosensitive drum, by an operation converse to the previously described operation, and the developing device 9 will assume the position as shown in FIG. 3 with the inner side of the legs 30 and 31 being brought into engagement with the rail member 29 of the body. At this time, the engagement between the projected portion 92 of the protective cover 39 and the stopper member 93 of the body is released. In this position, the developing device 9 is inserted into the apparatus body. After the developing device 9 has been inserted into a predetermined position within the apparatus body, the lever 25 is pivoted counter-clockwise, whereby the developing device 9 is positioned at the position shown in FIG. 5(*a*).

In the above-described manner, mounting of the developing device into the apparatus body is accomplished.

The present embodiment has been described as an example in which movement of the protective cover members is operatively associated with movement of the handle, and in this example, the handle for carrying the developing device is endowed with another function, whereby simplification, improved operability and reduced cost of the entire developing device are achieved.

However, the present invention is not restricted to such a construction, but it is of course possible to provide a member exclusively for use for operating the protective covers and operatively associate this member with the protective cover members.

Also, in the present embodiment, a developing sleeve having a magnetic member therein has been described as the developer conveying member, but the present invention is also applicable to a device in which developer is conveyed only by a magnetic member.

Of course, the developer used may be either a one-component developer using toner alone or a two-component developer using a mixture of toner and carrier particles.

What we claimed is:

1. A developing device adapted to be removably mounted with respect to an image forming apparatus and to develop a latent image on an image bearing member when it is mounted with respect to said image forming apparatus, said developing device having:

developer conveying means for carrying a developer thereon and conveying the developer to the latent image on said image bearing member;

support means for supporting said developer conveying means;

protecting means for covering and protecting said developer conveying means, said protecting means being movable to a first position for covering said developer conveying means and a second position retracted from said first position;

a handle for carrying said developing device, said handle being moveable relative to said support means; and connecting means for mechanically connecting said handle to said protecting means so that said protecting means is moved from said second position to said first position or from said first position to said second position in response to the movement of said handle relative to said support means.

2. A developing device according to claim 1, wherein said support means comprises the housing of said developing device for containing the developer therein, an opening being formed in that side of said housing which faces the image bearing member, and said developer conveying means being positioned in said opening of said housing.

3. A developing device according to claim 2, wherein said developer conveying means comprises a rotatable developing sleeve and a magnetic member secured in said sleeve.

4. A developing device according to any one of claims 1 to 3, wherein said handle is adapted to be drawn out or received relative to said support means, and said protecting means is moved from said second position to said first position when said handle is drawn out from said support means, and is moved from said first position to said second position when said handle is received in said support means.

5. A developing device according to claim 4, wherein said protecting means comprises an engaging portion engaged with the fixed member of the body of said image forming apparatus, and said developing device is removable from said image forming apparatus only by releasing the engagement between said fixed member of said body and said engaging portion by operation of said handle after said developing device has been horizontally drawn out from the body of said image forming apparatus.

6. A developing device according to claim 3, further comprising rollers at the opposite ends of said developing sleeve for maintaining the gap between said image bearing member and said developing sleeve, the outside diameter of said rollers being somewhat greater than the outside diameter of said developing sleeve, and protecting members for covering and protecting said rollers, said protecting members being mechanically connected to said handle and movable to a first position for covering that side of said rollers which faces said image bearing member and a second position retracted from said first position in response to the movement of said handle relative to said support means.

7. A developing device adapted to be removably mounted with respect to an image forming apparatus and to develop a latent image on an image bearing member when it is mounted with respect to said image forming apparatus, said developing device having:

developer conveying means for carrying a developer thereon and conveying the developer to the latent image on said image bearing member;

a gap holding member for engaging with said image bearing member when the developing device is mounted in said image forming apparatus so as to hold the gap between said developer conveying means and said image bearing member at a predetermined distance;

support means for supporting said developer conveying means and said gap holding member; and protecting means for covering and protecting said developer conveying means and said gap holding member, said protecting means being movable to a first position for covering that side of said developer conveying means and said gap holding member which faces the image bearing member and a second position retracted from said first position;

said protecting means assuming said first position when said developing device is removed from said image forming apparatus, and said protecting means assuming said second position when said developing device is mounted in said image forming apparatus and is in at least a position in which it is capable of effecting development.

8. A developing device according to claim 7, wherein said support means comprises the housing of said developing device for containing the developer therein, an opening being formed in that side of said housing which faces the image bearing member, and said developer conveying means being positioned in said opening of said housing.

9. A developing device according to claim 8, wherein said developer conveying means comprises rotatable developing sleeve and a magnetic member secured in said sleeve, and said gap holding member comprises rollers provided at the opposite ends of said developing sleeve and having an outside diameter somewhat greater than the outside diameter of said developing sleeve.

10. A developing device according to any one of claims 7 to 9, wherein said protecting means comprises a first protecting member for covering and protecting said developer conveying means, and a second protecting member for covering and protecting said gap holding member.

11. A developing device according to claim 10, further comprising a member for connecting said first protecting member to said second protecting member and wherein when said first protecting member is moved from said second position to said first position or from said first position to said second position, said second protecting member is moved from said second position to said first position or from said first position to said second position in response to the movement of said first protecting member.

12. A developing device adapted to be removably mounted with respect to an image forming apparatus and to develop a latent image on an image bearing member when it is mounted with respect to said image forming apparatus, said developing device having:

a housing for containing the developer therein;

developer conveying means for carrying a developer thereon and conveying the developer to the latent image on said image bearing member from said housing, said developer conveying means being positioned in an opening formed in that side of said housing which faces the image bearing member when said developing device is mounted in said image forming apparatus;

protecting means for covering and protecting said developer conveying means, said protecting means being movable to a first position for covering a part of said developer conveying means which is exposed through said opening and a second position retracted from said first position;

operating means mechanically connected to said protecting means for selectively applying to said protecting means a force which moves said protecting means from said second position to said first position and a force which moves said protecting means from said first position to said second position; and a movable engaging portion which, when said developing device is removed from said image forming apparatus, if said protecting means being located at said first position, engages with a stopper member provided at said image forming apparatus to obstruct the removal but if said protecting means being located at said second position, locates at a position not engaging with said stopper member.

13. A developing device according to claim 12, wherein said engaging portion is mechanically connected to said operating means and is movable in response to the operation of said operating means.

14. A developing device according to claim 12 or 13, wherein said engaging portion is fixed to said protecting means.

15. A developing device according to claim 12 or 13, wherein said operating means comprises a handle for carrying said developing device mounted relatively movable to said housing.

16. A developing device adapted to be removably mounted with respect to an image forming apparatus and to develop a latent image on an image bearing member when it is mounted with respect to said image forming apparatus, said developing device having:

a housing for containing the developer therein;

a developer conveying means for carrying a developer thereon and conveying the developer to the latent image on said image bearing member from said housing, said developer conveying means being positioned in an opening formed in that side of said housing which faces the image bearing member when said developing device is mounted in said image: forming apparatus;

protecting means for covering and protecting said developer conveying means, said protecting means being movable to a first position for covering a part of said developer conveying means which is exposed through said opening and a second position retracted from said first position; and movable means mechanically connected to said protecting means, the movable means being located at a third position when said protecting means locates at said first position and at a fourth position when said protecting means locates at said second position, and when said movable means locating at said fourth position, said movable means striking against said image forming apparatus to prevent said developing device from being inserted into said image forming apparatus.

17. A developing device according to claim 16, wherein said movable means is adapted selectively to apply to said protecting means a force which moves said protecting means from said second position to said first position and a force which moves said protecting means from said first position to said second position.

18. A developing device according to claim 17, wherein said movable means comprises a handle for carrying said developing device movably mounted to said housing.

* * * * *